US006951517B2

(12) United States Patent
Lindsay

(10) Patent No.: US 6,951,517 B2
(45) Date of Patent: Oct. 4, 2005

(54) PUTTER-HEADS

(76) Inventor: Norman Matheson Lindsay, 19 Batchelors Way, Amersham, Buckinghamshire HP7 9AH (GB)

( * ) Notice: Subject to any disclaimer, the term of this patent is extended or adjusted under 35 U.S.C. 154(b) by 0 days.

(21) Appl. No.: 10/488,152

(22) PCT Filed: Sep. 2, 2002

(86) PCT No.: PCT/GB02/03995

§ 371 (c)(1),
(2), (4) Date: Feb. 27, 2004

(87) PCT Pub. No.: WO03/020372

PCT Pub. Date: Mar. 13, 2003

(65) Prior Publication Data

US 2004/0214659 A1 Oct. 28, 2004

(30) Foreign Application Priority Data

| | | |
|---|---|---|
| Sep. 1, 2001 | (GB) | 0121261 |
| Dec. 22, 2001 | (GB) | 0130838 |
| Mar. 14, 2002 | (GB) | 0205962 |
| Apr. 20, 2002 | (GB) | 0209060 |
| May 9, 2002 | (GB) | 0210581 |

(51) Int. Cl.[7] ..... A63B 53/02; A63B 53/04

(52) U.S. Cl. ..... 473/313; 473/340; 473/341; 473/349; 473/330

(58) Field of Search ..... 473/324–350, 473/219–256, 305–315; D21/736–746

(56) References Cited

U.S. PATENT DOCUMENTS

| | | | | |
|---|---|---|---|---|
| 1,319,802 A | * | 10/1919 | Shea | 473/340 |
| 2,222,534 A | | 11/1940 | Harris | |
| 3,851,877 A | * | 12/1974 | Giambazi | 473/313 |
| 4,010,958 A | * | 3/1977 | Long | 473/341 |
| 4,162,074 A | | 7/1979 | Thomson | |
| 4,693,478 A | * | 9/1987 | Long | 473/251 |
| 4,984,799 A | | 1/1991 | Finney | |
| 5,058,895 A | * | 10/1991 | Igarashi | 473/341 |
| 5,060,950 A | | 10/1991 | Finney | |

(Continued)

FOREIGN PATENT DOCUMENTS

| | | |
|---|---|---|
| GB | 2 213 390 | 8/1989 |
| GB | 2 354 452 | 3/2001 |
| GB | 2 358 806 | 8/2001 |

*Primary Examiner*—Sebastiano Passaniti
(74) *Attorney, Agent, or Firm*—Davis & Bujold, P.L.L.C.

(57) ABSTRACT

A putter-head (1) has its center of mass (15) spaced p mm behind its impact-face (8) at a height $h_c$ mm above the head-bottom (9), a loft angle $\alpha_{12}$ at height 12 mm above the head-bottom (9), a moment of inertia/kg-mm$^2$ about the vertical axis through the center of mass (15), a mass M kg and a radius of gyration of K mm about the heel-toe axis (2–10) of the head through the center of mass (15), where p/l is not more than 0.18, $h_c$ is less than $[12-p\times\sin(\alpha_{12})]$, and a parameter $G=[p+(3.2+70\times M)\times K^2/p]$ is less than 350. The ratio $d_2/K$ is less than 1.0, $d_2$ mm being the vertical offset above the heel-toe axis (2–10) of the axis of attachment of the putter-shaft (3) to the putter-head (1); the attachment-axis of the shaft may be spaced by no more than the shaft-radius from the center of mass. The impact-face (36) may have an upper flat section (38) that merges smoothly into a cylindrical lower section (39), and the head (30) may be constructed with a high-density part (32;40) that extend lengthwise of the heel-toe axis and is either bonded to the underside of a lower-density part (31), or forms both an upstanding front flange (43) and a rear body-section (41) of larger mass than, and spaced from, the flange (43).

25 Claims, 8 Drawing Sheets

U.S. PATENT DOCUMENTS 5,131,656 A * 7/1992 Kinoshita ..... 473/341
5,308,068 A 5/1994 Strand
5,308,069 A * 5/1994 Paquette ..... 473/313
5,494,288 A * 2/1996 Jimenez et al. ..... 473/313
5,676,606 A 10/1997 Schaeffer et al.
5,683,307 A 11/1997 Rife
5,830,078 A * 11/1998 McMahan ..... 473/252
6,095,931 A 8/2000 Hettinger et al.
6,183,380 B1 * 2/2001 Yim ..... 473/330
6,270,422 B1 8/2001 Fisher

* cited by examiner

PUTTER-HEADS

This application is a national stage completion of PCT/GB02/03995 filed Sep. 2, 2002 which claims priority from British Application Serial No. 0210581.5 filed May 9, 2002, British Application Serial No. 0209060.3 filed Apr. 20. 2002, British Application Serial No. 0205962.4 filed Mar. 14, 2002, British Application Serial No. 0130838.6 filed Dec. 22, 2001, and British Application Serial No. 0121261.2 filed Sep. 1, 2001.

FIELD OF THE INVENTION

This invention relates to putter-heads.

BACKGROUND OF THE INVENTION

In putting a golf ball, it is desirable to impart forward rolling spin or topspin to the ball during the putting stroke. Topspin reduces ball skid on the putting surface and helps to initiate pure rolling motion, and it one of the objects of the present invention to provide an improved putter-head for imparting topspin to a golf ball on impact.

SUMMARY OF THE INVENTION

According to the present invention there is provided a putter-head having a centre of mass located at a distance p millimeters behind its impact-face at a height $h_c$ millimeters above the bottom of the head, a moment of inertia 1 kilogrammes-millimeters$^2$ about the vertical axis through the centre of mass, a mass of M kilogrammes and a radius of gyration of K millimeters about the heel-toe axis of the head through the centre of mass, wherein:

(a) p/l is not more than 0.18;

(b) $h_c$ is less than $[12-p\times\sin(\alpha_{12})]$ where $\alpha_{12}$ is the loft angle at a height of 12 millimeters above the bottom of the head; and (c) a parameter G defined by:

$$G=p+(3.2+70\times M)\times K^2/p$$

has a value less than 350.

The combination of features (a) to (c) of the putter-head according to the invention has been found to endow it with advantageous characteristics that are not achieved with known forms of putter-head. More particularly, the spacing of the centre of mass behind the impact-face and its height above the bottom of the head, together with the moment of inertia of the head about the vertical axis through the centre of mass, and the radius of gyration about the heel-toe axis, and the inter-relationship between them, have been identified as being significant for achieving enhanced putting characteristics. A selection is made of practical ranges of the parameters involved, towards achieving effective design principles that can be readily implemented to give topspin advantageously, without undesirably affecting other characteristics.

Certain preferences within the selection have been identified according to the invention, that lead to further improvement of the putting characteristics as compared with putter-heads of the prior art. In particular, the value of the parameter G is preferably less than 250, or more preferably less than 170, and the height $h_c$ is preferably not more than 8.5 millimeters, or more preferably not more than 7 millimeters.

The location of attachment of the putter-shaft to the putter-head has been found to have a significant effect on putting characteristics of the head. In particular, ratios $d_1/K$ and $d_2/K$, relating respectively the horizontal offset $d_1$ millimeters of the attachment from the said heel-toe axis, and its vertical offset $d_2$ millimeters above that axis, to the radius of gyration K, are relevant. Either or, desirably, both may have a value less than 1.0, or more preferably, less than 0.33. The horizontal offset $d_1$ may in particular have a value that is less than the radius r (in millimeters) of the putter-shaft, and may indeed be zero, and the vertical offset $d_2$ may be negative. More especially, the spacing of the attachment from the centre of mass may with advantage be no more than K millimeters, or even r millimeters.

The putter-head may be such that either or both of the functions $D_5$ and $D_{17}$ defined by:

$$D_5=[(3.2+70\times M)\times K^2+p^2]\times[h_M-5+p\times\sin(\alpha_5)]^{-2}$$

$$D_{17}=[(3.2+70\times M)\times K^2+p^2]\times[h_M-17+p\times\sin(\alpha_{17})]^{-2}$$

has a value more than 37 (or preferably not less than 60, or more preferably, 120), where the height $h_M$ is given by:

$$h_M=h_c+p\times[0.12+\sin(\alpha_M)],$$

and $\alpha_5$, $\alpha_{17}$ and $\alpha_M$ are the loft angles of the impact-face at heights of 5, 17 and $h_M$ millimeters respectively, above the bottom of the head.

Furthermore, the impact-face of the putter-head of the invention may be a flat surface throughout, or may have upper and lower sections that are contiguous with, and merge smoothly into, one another, the upper section being a flat surface and the lower section having the form of part of the surface of a cylinder that has its axis parallel to the heel-toe axis of the putter-head. In this latter case, or more generally, the impact-face may comply with the following function involving the height $h_i$ (millimeters above the bottom of the head) where impact takes place, and the loft $\alpha_i$ there, namely:

$$h_i-p\times\sin(\alpha_i)$$

is more than the height $h_c$.

The putter-head may comprise two parts a first of which is of high-density material and the second of which is of a lower-density material, the two parts being bonded together with the first part under the second part or located low down within it. Alternatively, the putter-head may be of metal or high-density composite having an upstanding front flange and a rear body-portion spaced from the flange, wherein the rear body-portion is of larger mass than the flange and extends beyond it in either direction lengthwise of the heel-toe axis.

BRIEF DESCRIPTION OF THE DRAWINGS

Putter-heads in accordance with the present invention will now be described, by way of example, with reference to the accompanying drawings, in which.

DETAILED DESCRIPTION OF THE INVENTION

Figure 1:
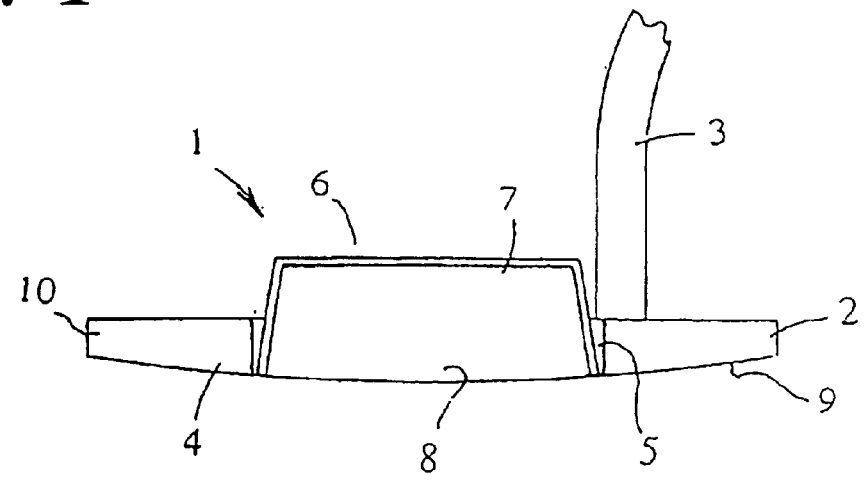
FIG. 1 is a front elevation of part of a putter incorporating a first putter-head according to the invention.
Figure 2:
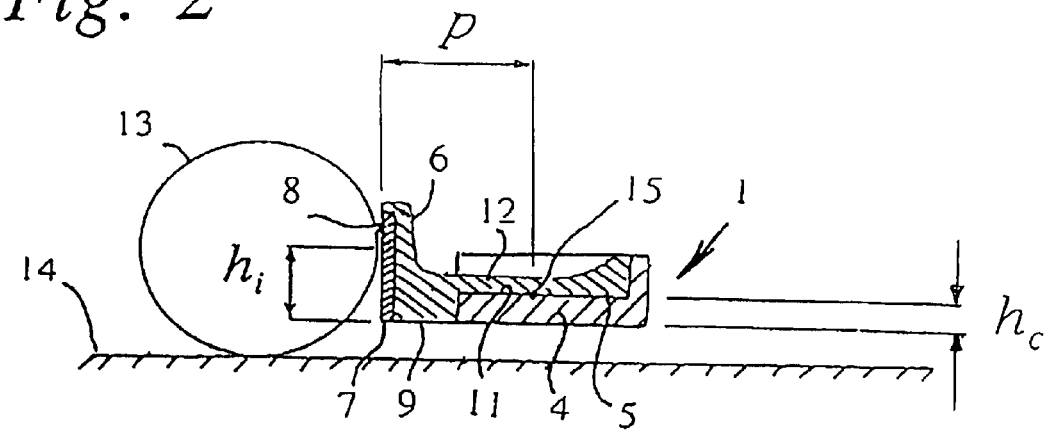
FIG. 2 is a sectional side-elevation of the putter-head of FIG. 1, shown together with the outline of a golf ball on a putting surface.

Referring to FIGS. 1 and 2, the putter-head 1, which is attached near its heel 2 to a putter-shaft 3, comprises a substantially flat-topped base 4, a bumper 5 bonded firmly to the base 4 and having an upstanding forward flange 6, and an element 7 that is inset in, and bonded to, the front of the flange 6 to provide the impact-face 8 of the head 1. The base 4 extends the length of the head 1 with a curved bottom or sole 9, to define the toe 10 of the head 1 as well as its heel 2.

In practice there may be departure from the somewhat strictly-rectangular configuration shown for the base 4, to incorporate stylistic features, angled surfaces and rounded edges. In order to conform to the Rules of Golf, the putter head of FIGS. 1 and 2 should have only one surface, namely impact-face 8, that can be used as an impact-face; the opposite, rear face and the toe and heel ends should thus contain features which prevent them from being usable in this regard.

Figure 3:
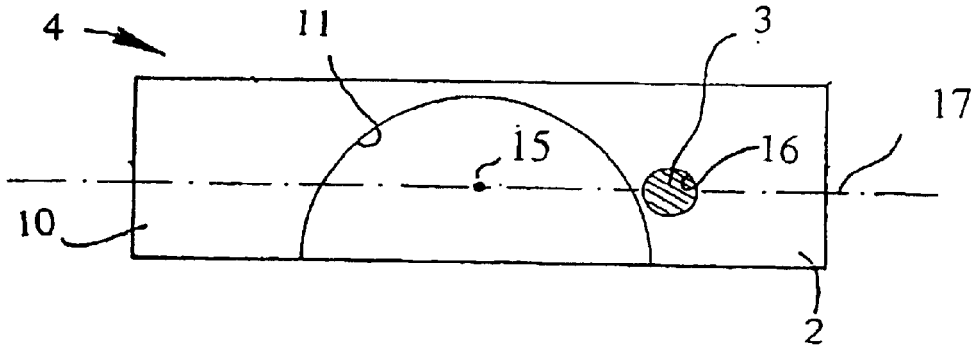
FIG. 3 is illustrative in plan view of a base part of the putter-head of FIG. 1.

As shown most clearly by FIGS. 2 and 3, material is removed from the top of the base 4 to leave a semi-cylindrical recess 11 located symmetrically between the heel 2 and toe 10. The portion 12 of the bumper 5 located behind the flange 6 fits closely into the recess 11, strengthening the bond with the base 4. The element 7 is bonded to the bumper 5 inset into the front of the flange 6, so as to be located forwardly (by several millimeters) of the base 4.

The base 4 is of metal or other high-density material and provides a high proportion of the overall mass of the putter-head 1. The bumper 5, in contrast, is of low-density material so as to have a very low mass, and is preferably of a material with high modulus-to-density ratio such as a high strength plastics or a fibre-reinforced composite. It is preferably significantly harder and more rigid than a golf ball (i.e. harder than 70 Shore D), and is rigidly bonded or otherwise attached to the base 4. In this manner, the base 4 and bumper 5 form a substantially single rigid body, with negligible flexibility in the mechanical interface between them.

The dimensions of the recess 11 are chosen to optimise the location of the centre of mass of the head 1 low down and rearwardly of the flange 6. The removal of material from the body 4 by way of the recess 11, reduces the mass of the head 1 but also shifts the centre of mass downwardly and backwardly depending on the depth and horizontal extent to which the recess 11 is taken. The shift downwardly and backwardly is accompanied by re-distribution of the resultant mass outwardly towards the heel 2 and toe 10. This helps to reduce rotation of the head 1 about its central vertical axis, and therefore to improve putt accuracy, in circumstances where impact with the ball is laterally offset from this axis.

The bumper 5 is designed for adequate strength but minimum weight, since its weight has significant influence on performance. It provides a very lightweight, rigid interface between the impact-face 8 and the base 4 and experiences negligible deformation during putting impact; impact deformation that does occur is limited primarily to the golf ball and/or the impact-face 8. Although the bumper 5, and the impact-face 8 along with it, might be extended so as to be of comparable length to the base 4, this would add superfluous weight where it is not wanted.

The element 7 is of a material having specific hardness and/or resilience and/or ball traction properties; typically it is of a different material from the bumper 5, but instead of being separate from the bumper 5 as in the present case, may be formed as part of it. The bumper 5 spaces the impact-face 8 of the element 7 several millimeters forwardly of the base 4 to ensure that there is a large separation between the face 8 and the centre of mass of the putter-head 1. The front flange 6 is the highest part of the bumper 5 and is higher than any part of the base 4, and the vertical and horizontal dimensions of the face 8 allows reliable contact with a golf ball for the full range of impact offset-errors encountered during normal play.

For the purpose of further description of the present invention, reference will be made specifically to FIG. 2, which shows the head 1 at the instant of impact with a golf ball 13 resting on a putting surface 14. By way of illustration, the centre of mass 15 of the head 1 is shown located at a height $h_c$ millimeters above the sole 9 and at a distance p millimeters behind the impact-face 8, and the centre of impact (a playing variable with random error) is identified as being at a height $h_i$ millimeters above the sole 9. The impact-face 8 may be inclined to provide a few degrees (conventionally, +3 degrees) of loft angle, but it will be assumed initially in the description below, that the head 1 is moving horizontally at impact and that the impact-face 8 is (as illustrated) flat with zero loft angle, and therefore vertical at impact.

The main effect required of the impact is to launch the golf ball 13 with linear velocity aligned with the line of intended putt. The linear velocity is proportional to the hit velocity of the head 1, and the ball 13 would attain a maximum value of linear velocity $v_c$ with no spin when the impact-face 8 is square to the direction of movement of the head 1 and the centre of mass 15, the centre of mass of the ball 13 and the point of impact are co-linear. However, when the normal to the impact-face 8 at the point of impact is above the centre of mass 15 as in the case represented in FIG. 2, the deceleration force on the putter-head 1 due to the inertia of the ball 13, exerts a 'backspin' moment on the head 1 about its centre of mass 15, and this, by means of 'gear-effect', imparts topspin rotation $\omega$ on the ball 13. With the vertical offset of the impact from the centre of mass 15, the linear velocity $v_c$ will be less than the maximum; this is similar to the well-known loss of velocity (and distance) experienced when a ball is putted near the heel or toe (horizontally offset) rather than at the centre or 'sweet spot'.

It has been found that the position of the borehole 16 (FIG. 3) for attachment of the putter-shaft 3 has a strong influence on the putter-head rotation about the heel-toe axis during the very short duration of impact (less than one millisecond). This is especially the case where the moment of inertia about the heel-toe axis is relatively small, which is a necessary condition for imparting significant topspin. A preferred position for the borehole 16 is such that its axis intersects the rotation axis, that is to say, the heel-toe axis 17 (represented in FIG. 3) through the putter-head centre of mass 15. This minimises the stiffness to rotation caused by the shaft 3.

Figure 4:
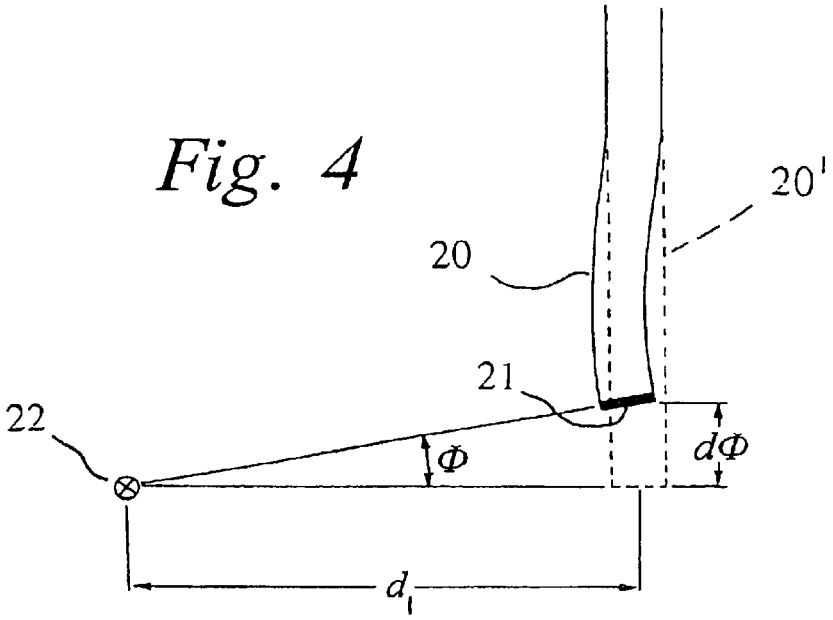
FIG. 4 illustrates in exaggerated form deformation of a shaft of a putter during impact of the putter-head with a ball.

FIG. 4 illustrates, in exaggerated form, deformation of a shaft 20 that results from a rotation $\phi$ radians where the shaft attachment 21 is offset horizontally by distance $d_1$ from the heel-toe axis 22 through the centre of mass of the putter-head; the un-deformed tubular shaft 20' is indicated in dotted line while the deformed shaft 20 is shown in solid line. There are two deformation components that oppose rotation about the heel-toe axis 22, namely axial compression of the shaft by amount $d\phi$ and bending through angle $\phi$. Deflection forces along the offset direction also occur, but these can be ignored, as they do not significantly affect rotation. The force required to compress the shaft has moment $M_1$ about the heel-toe axis 22 and the couple required to bend it has moment $M_2$. Applying standard formulae (see for example, Gere, J. M. 2001. *Mechanics of Materials*, Pacific Grove, USA: Brooks/Cole):

$$M_1=E\times A\times(d\phi/L)\times d \quad (1)$$

$$M_2=(E\times I_x\times\phi)/L \quad (2)$$

where: E is Young's modulus of the shaft;

A is the cross-sectional area of the shaft;

$I_x$ is the second moment of area of the shaft about its bending axis; and

L is the effective length of the shaft during impact.

Further, if the shaft has radius r, wall thickness t and that r>>t (which is usually the case), then:

$$M_1/M_2=2\times(d_1/r)^2 \quad (3)$$

Equation (3) demonstrates that the rotational stiffness is strongly dependant on offset $d_1$ and can be minimised by making $d_1$ zero (when no direct axial compression or tension occurs due to rotation about the heel-toe axis). As the offset $d_1$ increases above r the stiffness increases rapidly, so there is advantage if $d_1$ is less than r.

Equations (1) to (3) also show that non-standard shafts could reduce rotational stiffness. For t<<r, the second moment of area about a bending axis increases as $r^3$ but the cross-sectional area increases as r, so increasing r and t, while decreasing E (for example, replacing steel with an engineering plastic) can provide a shaft with the same flexural stiffness as a standard shaft but much less axial stiffness. This reduces rotational stiffness about the heel-toe axis when it is necessary to have $d_1$>r. In practice, shaft diameters of 10 to 20 millimeters or greater (compared to 9.4 millimeters in a standard shaft) can be provided using low modulus material to provide a shaft with ample strength and durability, but with much reduced stiffness.

With steel putter-shafts the radius and/or wall thickness of the shaft tip can be reduced. This allows for the fact that standard steel puffer-shafts with diameter 9.4 millimeters have much higher strength and stiffness than necessary, with greater flexural stiffness than driver shafts, which are subjected to much higher stress. Thus, steel or other alloy putter-shafts with small, non-standard shaft-tip diameters are usefully employed.

Further reduction in torque stiffness can be provided by arranging that the end of the shaft attaches to the putter-head at, or more preferably below, the heel-toe axis through the putter-head centre of mass. This is illustrated by reference to FIG. 5 which shows in exaggerated form at (a) to (c) three cases of deformation of a shaft 24, as follows:

(a) In this case the shaft 24 is considered unattached to its puffer-head, and subject to a force-couple F1—F1 applied to its free, attachment end 25, causing it to bend and rotate through an angle $\phi$ anti-clockwise. In the absence of any other force, this would also displace the end 25 to the right, but lateral force F2 maintains the end 25 in line with the un-deformed shaft 24'. Due to the finite deformation curvature, the shaft end 25 does not extend to the full length of the un-deformed shaft 24'.

(b) In the second case, the shaft 24 is attached at its end 25 to a putter-head (not shown) and so provides reactive forces that oppose anti-clockwise rotation of the putter-head through angle $\phi$ about the heel-toe axis 26 through the centre of mass of the putter-head. In this case the longitudinal axis of the un-deformed shaft 24' intersects with heel-toe axis 26 and the shaft end 25 is above the axis 26. The reactive forces comprise a clockwise force-couple F3—F3, substantially equal but opposite to F1—F1, a lateral force F4 opposite and greater than F2, and a tension force F5 which arises owing to the elongation of the shaft resulting from it being pulled down beyond the extent of the un-deformed shaft 24'.

(c) In the third case the shaft 24 is similarly considered attached to a putter-head but in this case the end 25 of the shaft end 24 is below the heel-toe axis 26. A clockwise force couple F6—F6 substantially equal but opposite to F1—F1 opposes rotation, but this in bending and rotating the shaft-end 25 anti-clockwise through angle $\phi$, deflects it to the right, which tends to reduce or eliminate lateral deflection forces. It also rotates upwards, which tends to reduce or eliminate shaft axial tension (or compression) forces that have moments opposing rotation about the heel-toe axis 26.

Figure 5:
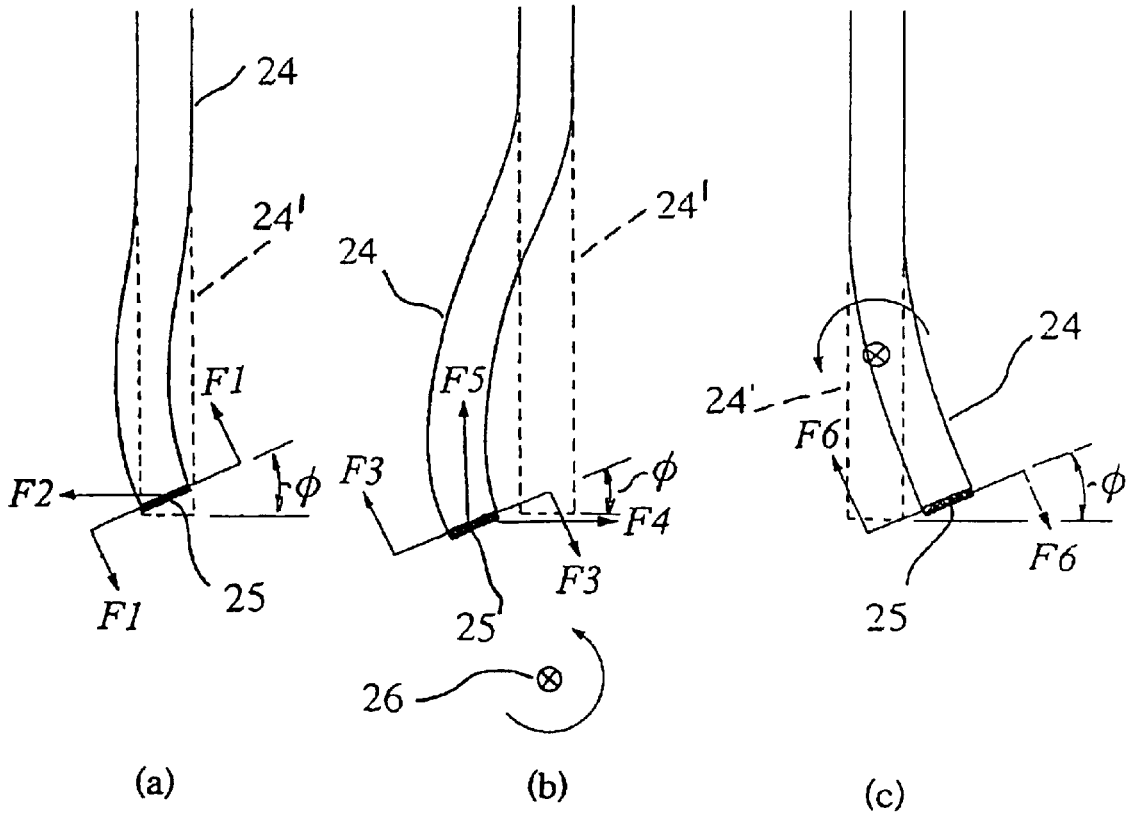
FIG. 5 illustrates in exaggerated form at (a) to (c) three cases of deformation of a putter-shaft that are referred to herein by way of explanation of features of a putter-head according to the present invention.
Figure 6:
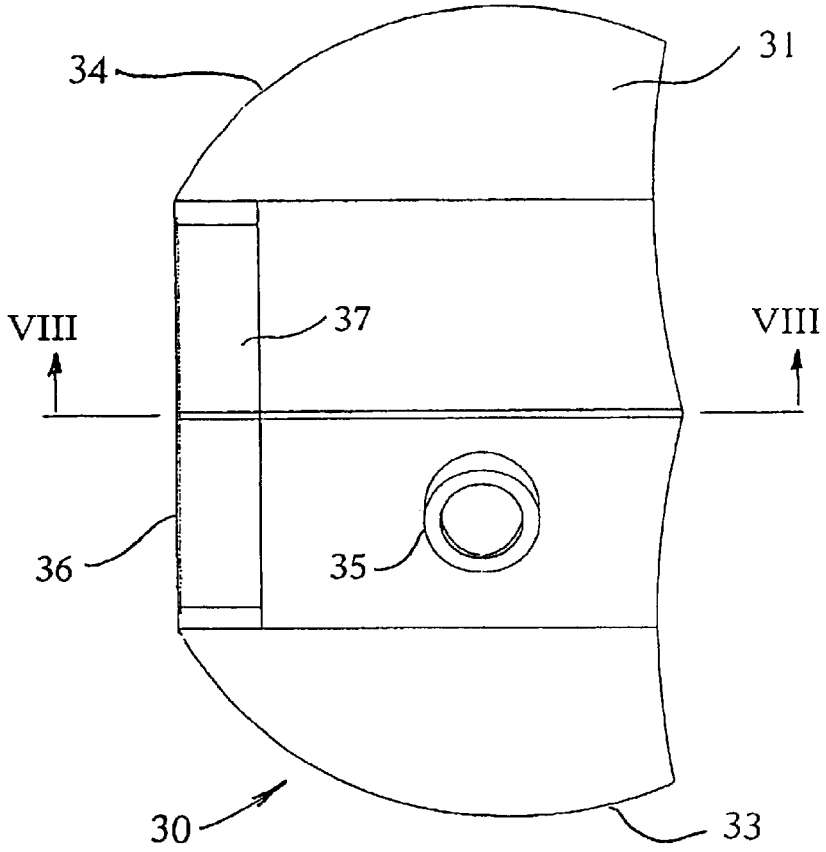
FIGS. 6 to 9 are, respectively, a plan, a front elevation, a sectional side-elevation and a perspective view of another putter-head according to the invention, the section of FIG. 8 being taken on the line VIII—VIII of FIG. 6.
Figure 7:
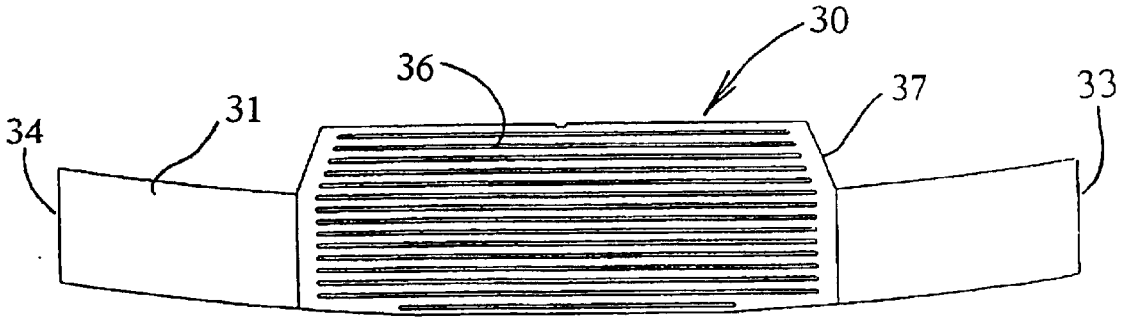

The above qualitative analysis with reference to (a) to (c) of FIG. 5 shows that significantly less rotational stiffness occurs when the shaft is attached below the heel-toe axis rather than above.

In practice, attaching the end of the shaft below the heel-toe axis is difficult with conventional means; typically an epoxy adhesive joint is used with the bonded section of the shaft extends 10 millimeters depth or more into the putter-head. Thus, implementation will require development of new attachment means where only a few millimeters of the shaft end is needed to make a reliable join.

It is found that minimising the torque stiffness also advantageously modifies the acoustic and vibration characteristics at impact. In this respect, it is also advantageous to arrange that the borehole or other means of shaft attachment is not only close to the heel-toe axis as described above, but positioned at, or close to, the centre of mass.

Other means of reducing the torque stiffness due to shaft attachment can be provided, including special low-stiffness shaft or shaft-coupling arrangements. A hosel extension or neck can be provided between the putter-head and the shaft-attachment point with small and elongate section to reduce torque stiffness about the heel-toe axis but maintain adequate strength and robustness. Traditionally, an adhesive is used to bond the shaft end into the borehole of the putter-head, so the resilience and thickness of the adhesive material can be designed to allow higher compliance, without compromising the stability and ruggedness of the bond.

It is established teaching that the head of a golf club (including that of a putter) behaves as a free body during impact. That is, during the very brief time of contact (less than one millisecond), the shaft has negligible influence on the outcome of the impact; see for example: Cochran, A. and Stobbs, J. 1968. *Search for the Perfect Swing*, Chicago: Triumph Books, p. 147. It is thus known that the outcome of a golf shot (including a putt) can be analysed as a case of eccentric, oblique impact in a two-body system comprising the ball and club-head only. From this, exact equations can be derived that predict the launch velocity and spin components of a golf ball. These equations give accurate prediction of many aspects of club-on-ball collision in golf. For convenience, we refer to these equations as 'basic impact equations'.

For example, it is well known that the so-called 'sweet spot' of a putter-head is normally mid-way between the heel and toe and corresponds almost exactly to the position of the centre of mass along the heel-toe axis. At the sweet spot, the ball launch velocity as a function of putter-head swing speed reaches a maximum, no head rotation from impact occurs and the contact is 'solid' with minimum vibration and sound—hence the name 'sweet spot'. This result is exactly as expected from the basic impact equations.

However, applicant's measurements of putter-head impact characteristics show that whereas the basic impact equations accurately predict dynamic behaviour for lateral eccentric impacts that cause rotation about the putter-head vertical axis, the prediction is inaccurate for vertical eccentric impact.

In vertical eccentric impact (above or below the sweet spot), the putter-head tends to rotate about the horizontal heel-toe axis. In this mode, the putter shaft presents maximum resistance to movement but the putter-head moment of inertia is a minimum (being especially small in putter-heads according to the present invention). Thus, the model of the putter-head as a free body is least representative for this mode. This gives rise to significant discrepancies between measured performance and performance predicted by the basic impact equations.

By contrast, in lateral eccentric impact, the shaft presents much lower resistance to movement about the putter-head vertical axis and, moreover, the moment of inertia about this axis is almost invariably a maximum (due to the practice of 'heel-toe weighting' to minimise putter-head rotation in this mode). Thus, the basic impact equations provide a much more accurate model for lateral eccentric impacts and also accurately predict the effect of direct oblique impact (as distinct from eccentric impact) since no club-head rotation at impact is involved and the shaft constraining forces are negligible.

A theoretical treatment of the ball-on-putter-head impact taking account of the shaft constraining forces would be very difficult and complex. In the present context therefore, the putter-head is considered as a free, rigid body detached from its shaft during impact, to which the basic impact equations are applied to predict performance. From this the maximum gear-effect attainable is calculated assuming no shaft constraining forces, and the result is then qualified to take account of the possible effect of torque stiffness during impact due to the shaft.

It is to be appreciated that any practical putter-head with suitable shaft attachment means can provide substantially all the available gear-effect performance predicted by the basic impact equations provided the shaft is sufficiently compliant. New shaft types for putters may be produced to satisfy this special requirement, but other factors, such as design aesthetics or user-preferred shaft type and set-up, may dictate the overall design so that all the available gear-effect performance is not utilised as a compromise between desired topspin performance and other factors.

The variables (including fixed golf-ball parameters) used in the basic impact equations comprise the mass and inertia parameters of the golf ball and putter-head, the ball radius, and the geometry or shape parameters of the putter impact-face. For the putter-head, the variables (and preferred units assumed herein) are:

M mass (kilogrammes);

$h_c$ height of centre of mass above the bottom-most part of the putter-head (millimeters);

p distance of centre of mass behind the impact-face (millimeters);

K radius of gyration for rotation about the horizontal heel-toe axis through the centre of mass (millimeters);

$\alpha_i$ the putter face loft at the point of impact, taken as positive for upward tilt (degrees);

$h_i$ height of impact point measured above the bottom-most part of the putter-head (millimeters);

I moment of inertia about the vertical axis through the putter-head centre of mass (kilogrammes-millimeters$^2$);

The gear-effect realised with a putter-head is dependent on the condition that the line of impact (i.e. the line normal to the impact surfaces at the point of impact) is offset from the centre of mass of the head. It follows that the condition for gear-effect in the present invention is also dependent on the impact-face loft angle at the point of impact. The offset h between the line of impact and the centre of mass, is:

$$h=h_i-h_c-p\times\sin(\alpha_i) \tag{4}$$

To impart topspin on average rather than backspin, the average value of h must be positive. A golfer of average skill can execute putts with average impact heights of 12 millimeters or above, so the condition for h positive (on average) can be met if $h_c$ is less than:

$$12-p\times\sin(\alpha_{12})$$

where $\alpha_{12}$ is the impact-face loft angle at 12 millimeters height, measured from the bottom of the putter. This typically corresponds to an impact height on the face of the putter of about 10 to 11 millimeters, since the bottom lip of a putter-face is often raised above the true bottom surface of the putter by 1 to 2 millimeters. Preferably, having $h_c$ less than 8.5 millimeters, or more preferably less than 7.0 millimeters, increases the probability of topspin. Because the putter-shaft mass is above the putter-head, the shaft coupling will tend to increase the effective putter-head centre of mass slightly above the true $h_c$ value and so the transition from backspin to topspin will occur slightly higher on the impact-face than predicted by the basic impact equations.

Equation (4) shows that if:

$$h_i-p\times\sin(\alpha_i)>h_c$$

is true at every point of the impact-face, then topspin will always be imparted for normal putts.

Loft angles in putters are seldom greater than 5 degrees and more usually 3 degrees or less, so it can be seen that the third term on the right-hand side of equation (4), is only significant if p is large as in accordance with the present invention. The combination of high gear-effect and its sensitivity to loft angle allows useful modification of loft angle to enhance performance in putters of the present invention.

To a first approximation, the basic impact equations predict that the topspin initially increases linearly with both h and p and increases as the inverse of the putter-head moment of inertia (with radius of gyration K) about the horizontal heel-toe axis through the putter-head centre of mass.

The equations also show that as p is greatly increased the spin rate (for a given h) reaches a maximum and thereafter reduces, but this only occurs with unusually large p, so for most practical putter-heads it is safe to assume that increasing p increases the available topspin performance. Where the shaft attachment is positioned close to the impact-face of a putter, the effective value of p is likely to be less than its true value.

A direct result of increasing p is that sidespin from lateral eccentric impacts also increases. That is, when the impact point is offset from the sweet spot towards the heel or toe, an increased value of p gives rise to increased sidespin (all other factors being equal). The imparted sidespin is believed to have negligible influence on the direction of the putt (see Cochran, A. and Stobbs, J. 1968. *Search for the Perfect Swing*, Chicago: Triumph Books, p. 131), but the basic impact equations predict that a sideways component of launch velocity proportional to the sidespin magnitude is generated, which give rise to directional errors. This result has been verified by measurement and shown to be in close agreement with errors predicted by the basic impact equations. In this regard, it is an aim of the present invention to limit directional errors by providing sufficiently large values of/in putter-heads according to the invention, so that launch angle errors due to lateral impact offsets of ±12.7 millimeters (i.e. ±0.5 inch) are not more than ±1.6 degrees. In golfing terms, this corresponds to just sinking a six-foot putt providing all other aspects of the putt are perfect. A closely equivalent criterion (which derives from the basic impact equations) is that the ratio p/l should be less than 0.18.

Since topspin increases as the inverse of moment of inertia about the heel-toe axis, limiting this moment of inertia is another aim of the present invention. This involves selecting the overall putter-head mass and controlling the distribution of this mass about the heel-toe axis. Putter-heads are commonly made with mass in the range 0.25 kilogrammes to 0.45 kilogrammes but a narrower range of about 0.3 to 0.35 kilogrammes is preferred by many manufacturers. We thus see that the mass of a putter-head is traditionally kept within fairly narrow limits, presumably to reflect players' preferences. Therefore, control of the moment of inertia plays an important part in the design of putter-heads according to the present invention. Moment of inertia is proportional to the square of radius of gyration, so small changes in K can significantly alter the topspin performance. The applicant has found that the position of the shaft attachment can alter the effective value of K and this effect is seen as the most significant in regards to the problem of torque stiffness due to shaft attachment.

It has been proved experimentally that with both $d_1$ (the horizontal offset between the shaft attachment axis and the heel-toe axis) and $d_2$ (the vertical offset between the shaft point of attachment and the heel-toe axis) nearly zero, the performance of prototype putters according to the invention closely agrees with the performance predicted by basic impact equations, whereas increasing either $d_1$ or $d_2$ reduces the imparted topspin and also reduces the variation in launch velocity as a function of impact height. Thus, there is empirical evidence that if either $d_1$ or $d_2$ is greater than zero the effective radius of gyration $K_e$ is greater than the basic putter-head radius of gyration K (both measured about the heel-toe axis through the putter-head centre of mass). It follows that the ratios $d_1/K$ and $d_2/K$ are important design factors. It is considered that $d_1/K$ should be less than +1.0 or more preferably, less than +0.33 and similarly, $d_2/K$ should be less than +1.0 or more preferably, less than +0.33. However other design considerations may determine that one or both of these ratios is greater than +1.0.

A further advantage of positioning the shaft coupling close to the centre of mass is that shaft vibrations due to eccentric impact are minimised. In this respect, it is advantageous that the axis of the shaft attachment means passes close to the putter-head centre of mass (as distinct from the heel-toe axis through this centre). Some experimental evidence indicates that this arrangement is also best for ensuring that the assembled putter advantageously behaves most closely to the model predicted by the basic impact equations. It is thus preferable that the axis of the shaft attachment means is offset by less than K millimeters, or more preferably not more than the putter-shaft radius r millimeters, from the putter-head centre of mass, measured in any direction.

A putter-head in accordance with the invention, of 'mallet' style as distinct from the 'blade' style of the putter-head of FIGS. 1 to 3, will now be described with reference to FIGS. 6 to 9.

Referring to FIGS. 6 to 9, the putter-head 30 in this case involves a substantially rigid, low-density upper casing 31. An element 32 (see FIG. 8) to give mass is bonded, over-moulded or otherwise attached to the underside of the casing 31 to extend from heel 33 to toe 34 of the head 30. Alternatively, the element 32 may be embedded inside the casing 31 by over-moulding or by encapsulating between two injection-moulded parts or the like. In this arrangement the element 32 can advantageously be made from a high-density relatively-soft metal (such as lead alloy), and holes provided through it to assist firm bonding to the casing 32.

For cosmetic purposes, the casing 31 may be transparent or translucent and may be colour tinted or clear, with the element 32 visible through the casing. In this case, the element 32 may have a legend, emblem or other information printed, engraved or cast into it and visible inside the putter-head 30 through the casing 31; this allows the bottom surface or sole of the putter-head to contain such information but still be perfectly smooth.

The attachment socket 35 for the putter-shaft is located vertically above the heel-toe axis through the centre of mass of the head 30. More particularly, the socket 35 is angled so that its axis, and accordingly the longitudinal axis of the shaft, extends less than K millimeters from the centre of mass.

Figure 8:
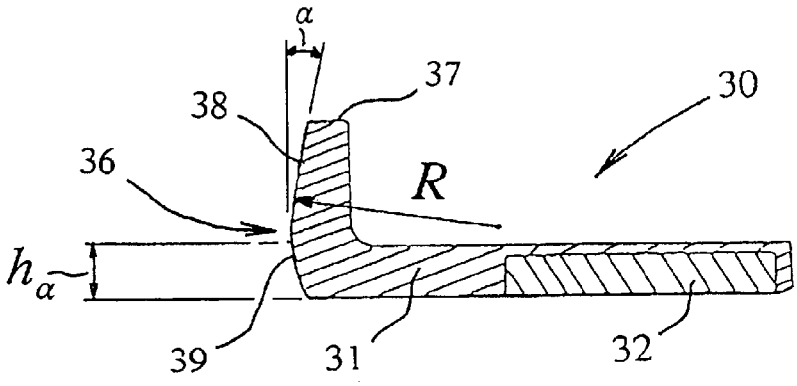
Figure 9:
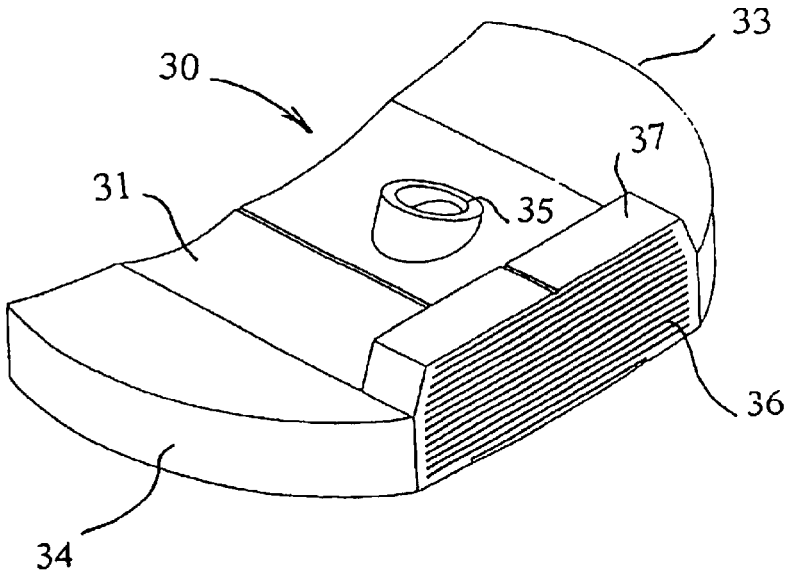

The impact-face of the head 30 is provided by an element 36 that is secured to an upstanding flange 37 of the casing 31; alternatively, the element 36 may be an integral part of the flange 37. As shown in FIG. 8, the impact-face has two sections 38 and 39 that are contiguous with, and merge smoothly into, one another. The upper section 38 is flat with positive loft angle $\alpha$, whereas the lower section 39 is curved having the form of part of the external surface of a cylinder of radius R and axis parallel to the heel-toe axis of the head 30; other surfaces of generally-convex curvature may be used.

The boundary between surfaces 38 and 39 is at height $h_\alpha$ millimeters. The lofted surface 38 slightly reduces topspin for high values of impact-height $h_i$ but improves the achieved length of putt by shifting the line of impact back towards the centre of mass at height $h_c$. Here, abundance of topspin is exchanged for slightly less topspin but improved distance control. Also, the progressively de-lofted surface 39 extends topspin and putt length at low values of impact-height $h_i$. The line of impact is raised relative to the centre of mass and negative oblique impact is introduced; both assist topspin and extend putt distance with low impact-height $h_i$, the compromise being that negative loft is introduced.

Negative loft occurs only at the lower section 39 of the impact-face. This is not disadvantageous in practice since putting styles with high loft at impact tend to result in impacts with low height $h_i$ so that negative loft is cancelled by the orientation of the putter-head at impact. Conversely, putting styles with low loft at impact tend to result in impacts with high values of height $h_i$ where the positive loft of the putter and/or high topspin helps to lift the ball at impact.

The degree of imparted topspin (or backspin) from a putter impact is conveniently quantified in terms of the ratio (namely, S percent) of the ball peripheral velocity due to spin to its linear velocity (that is, the translational velocity of the ball centre). From the basic impact equations, S can be approximated as two independent terms: one linearly proportional to h (defined in equation (4) above) and the other linearly proportional to the obliqueness angle at impact. The obliqueness angle is dependent on the putter-face loft angle at impact ($\alpha_i$) and also on the putting style (namely, whether the style is 'pendulum swing style' or swung with the putter shaft tilted forwards or backwards at impact). In putters according to the invention, the component of S due to oblique impact is very small compared to the gear-effect (eccentric impact) component.

Figure 10:
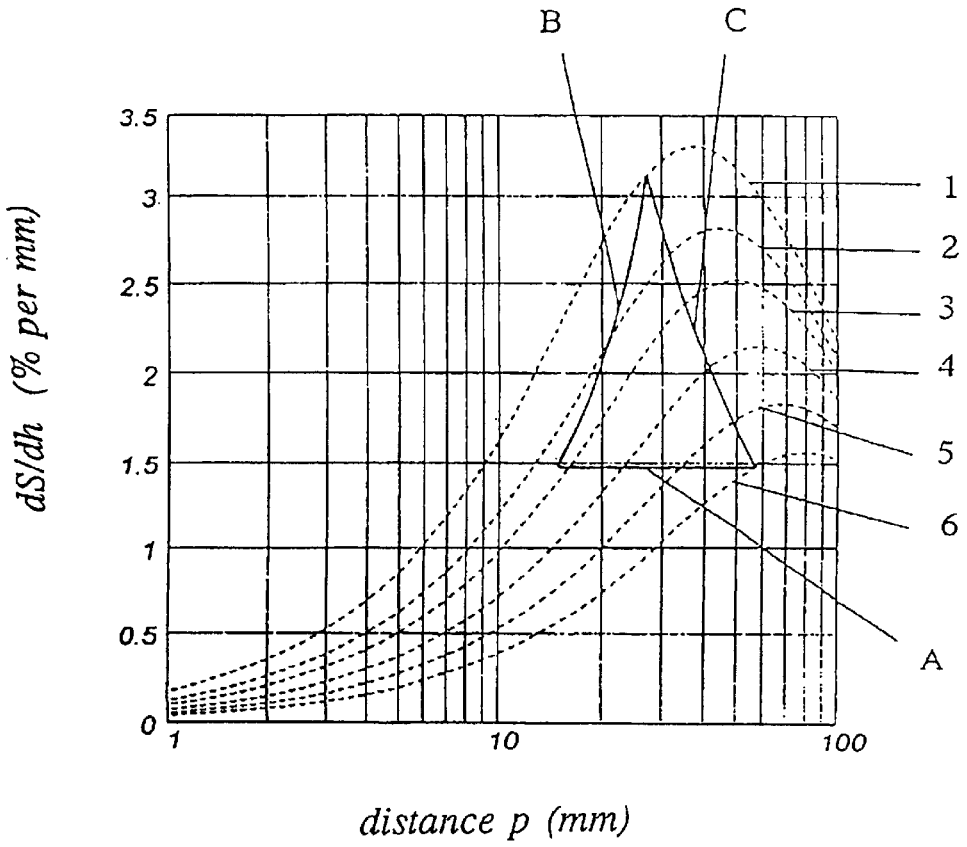
FIGS. 10 to 12 are graphs illustrative of characteristics referred to by way of explanation and description of features of putter-heads according to the present invention.

The function dS/dh is the rate of change of imparted spin as a function of h and is very nearly constant for any given putter-head with given values of M, K and p, and provides an important measure of putter-head performance. FIG. 10 shows curves 1 to 6 plotted for dS/dh (in percent per millimeter) as a function of p for various values of K and M identified in the following Table I.

TABLE I

| Curve | K | M | $M \times K^2$ |
|---|---|---|---|
| 1 | 8.4 | 0.25 | 17.6 |
| 2 | 8.4 | 0.35 | 24.7 |
| 3 | 11.0 | 0.25 | 30.3 |
| 4 | 11.0 | 0.35 | 42.4 |
| 5 | 15.1 | 0.25 | 57.0 |
| 6 | 15.1 | 0.35 | 79.8 |

Curves 1 to 6 show that for a typical range of putter-head mass, the spin rate decreases with K and M and is particularly sensitive to K. The moment of inertia of the putter-head about the heel-toe axis through the centre of mass is equal to ($M \times K^2$) and this is evaluated in the fourth column of Table 1. From this, it can be seen that spin rate is approximately inversely proportional to the heel-toe axis moment of inertia.

Also, for any given value of heel-toe axis moment of inertia, a value of p equal to about $[8.9 \times K \times M^{1/2}]$ gives the maximum value for the constant dS/dh. However, these values of p are very difficult to implement. For example, with K equal to 14 millimeters, a putter-head of 0.3 kilogrammes requires a value for p of about 70 millimeters, which results in a very large and cumbersome putter-head. On the other hand, small values of K such as 8 millimeters can only be achieved in putter-heads of normal length and mass by using very expensive materials such as tungsten alloys, combined with low density, high modulus composites. Even then, attaining maximum dS/dh is very difficult.

For convenience, a function G which provides a measure of the dS/dh characteristic of a putter-head is defined as:

$$G=p+(3.2+70\times M)\times K^2/p \tag{5}$$

In prior art, typical values for K are 11 to 12 for blade style putters, increasing to 14 to 17 for mallet styles, with corresponding p values of about 8 to 10 (blade style) increasing to 14 to 18 (mallet style). Thus, the value of G in the prior art is normally greater or much greater than 350. To allow enhanced topspin in putter-heads according to the invention, the value of G should be less than 350. For preference G should be less than 250, or more preferably less than 170.

It has been found that a putter-head design with exceptionally high topspin can result in severe loss of linear velocity and consequently, loss of putt distance. It is thus desirable to calculate the variation in putt length as a function of launch velocity and imparted topspin variations, and use this information to modify, if necessary, putter-head parameters so as to obtain satisfactory puff distance performance. The theory of spherically symmetrical balls sliding and/or rolling on a flat uniform surface is well documented. Thus, exact equations can be derived predicting the initial linear deceleration and accompanying rotational acceleration due to sliding friction and, once pure rolling motion is achieved, linear deceleration by rolling friction that eventually slows the ball to standstill.

Figure 11:
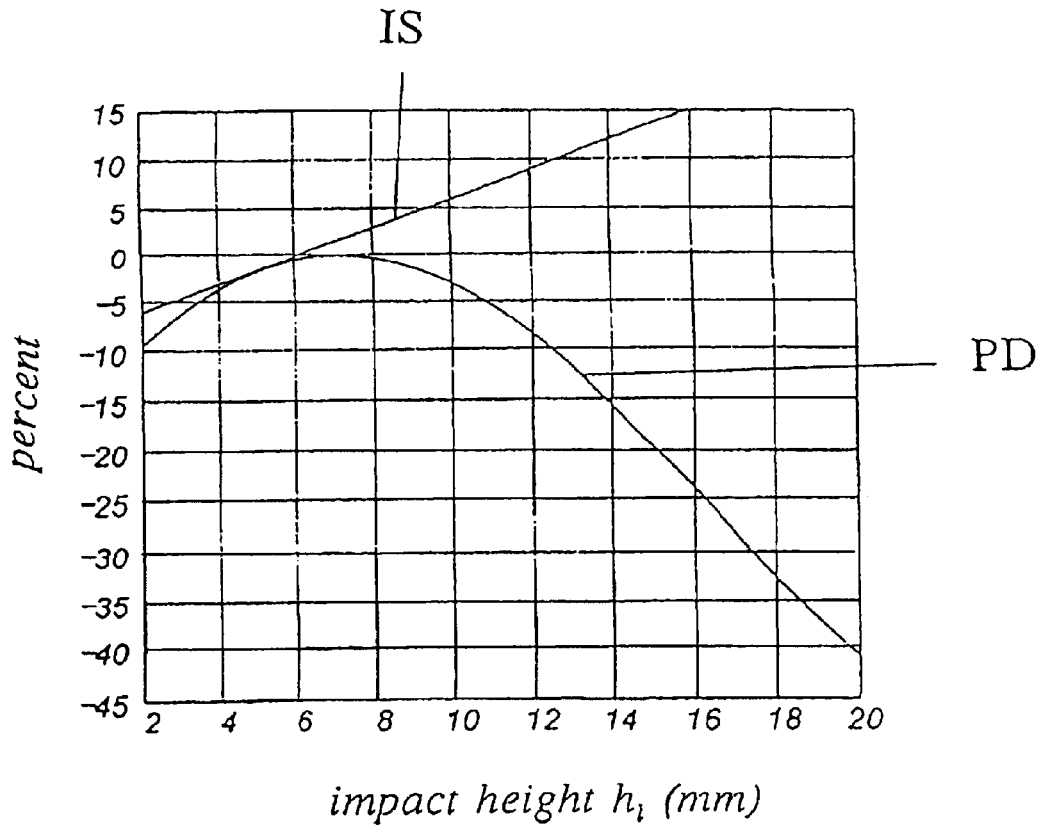

In FIG. 11 relative putt distance PD (with zero corresponding to longest distance) and imparted spin IS for a possible design of putter-head having the parameters of Table II are plotted as a function of impact height $h_i$.

TABLE II

| | |
|---|---|
| M | 0.3 |
| K | 8 |
| p | 10 |
| $h_c$ | 6 |
| $\alpha$ | 0 |
| $h_\alpha$ | 0 |
| R | — |

FIG. 11 shows that this combination of parameters gives excellent topspin (with G=165) but the relative putt distance falls off very severely above the mid-height impact region, reducing to −40% at 20 millimeters. This would be unsatisfactory for even the least discerning player so a balance is required between high topspin characteristics and putt-length characteristics. It is desirable to select parameters to ensure that relative putt distance is within acceptable limits over the full range of impact heights.

A standard golf ball radius is only 21.3 millimeters, so a possible putter impact height of 20 millimeters allows a very small clearance above ground to avoid dragging effects of the turf. With impact height of 2 millimeters or less, the ball is struck very near the bottom lip of the impact-face, where impact consistency becomes unreliable and launch elevation becomes increasingly negative. There is thus a possible range of about 2 to 20 millimeters, but in practice impact height will rarely exceed limits of between 5 to 17 millimeters and will average around 10 to 12 millimeters. It is preferable to ensure that distance loss relative to the peak distance achieved (for any given putt strength) is not more than 15%. In this regard, it is useful to define the following functions:

$$D_5=[(3.2+70\times M)\times K^2+p^2]\times[h_M-5+p\times\sin(\alpha_5)]^{-2} \tag{6}$$

$$D_{17}=[(3.2+70\times M)\times K^2+p^2]\times[h_M-17+p\times\sin(\alpha_{17})]^{-2} \tag{7}$$

where:

$$h_M=h_c+p\times[0.12+\sin(\alpha_M)] \tag{8}$$

In the above, $h_M$ and $\alpha_M$ are the impact height and loft where maximum length is achieved for a given putt strength. Due to topspin assistance, $h_M$ is higher than the 'sweet spot'. Loft angles $\alpha_5$ and $\alpha_{17}$ are measured at heights of 5 and 17 millimeters above the bottom of the putter-head. Where grooves, ridges or other impact surface modifications are present, the loft angle is measured on the co-tangent of two adjacent outer extremities of the impact surface. For any possible form of impact-face, the magnitudes of $\alpha_5$ and $\alpha_{17}$ are to be taken as the lesser of 10 degrees or the measured value.

The functions $D_5$ and $D_{17}$ indirectly quantify the relative distance loss at 5 and 17 millimeters impact heights (assuming the basic impact equation performance). These functions give very good prediction for a wide range of typical putter-head mass. With $D_5$ and $D_{17}$ both greater than 37.0 the distance loss (relative to the maximum at $h_M$) at impact height limits of 5 and 17 millimeters is not greater than 15% or so. The value of functions $D_5$ and $D_{17}$ may for preference be not less than 60, or, more preferably, not less than 120, which correspond to relative distance losses of about 10% and 5% respectively.

As referred to earlier, the main effect of torque stiffness due to shaft attachment, is to increase the effective radius of gyration (that is, $K_e$ is larger than K). Furthermore, from equations (6) and (7), $D_5$ and $D_{17}$ increase rapidly with increasing K. This shows that torque stiffness due to shaft attachment improves rather than degrades the value of $D_5$ and $D_{17}$, so the design aim of providing topspin within acceptable limits of putt length variation, is enhanced by shaft attachment.

Three curves A, B and C superimposed on the curves 1 to 6 in FIG. 10 mark the boundaries for preferred combinations of K, M and p for putter-heads according to the present invention. Thus, curve A represents the condition in which the value of function G is 170, and curve B represents the condition in which the values of $D_5$ and $D_{17}$ are both 60 for typical values of $h_M$, $\alpha_5$ and $\alpha_{17}$. Curve C passes through the points in the dS/dh curves where the magnitude is 95% of peak value, which is taken as a practical limit of p. This provides nearly maximum gear-effect sensitivity for a given K and M combination, but with values of p that are relatively easily implemented. However, larger values of p may be used if required.

Figure 12:
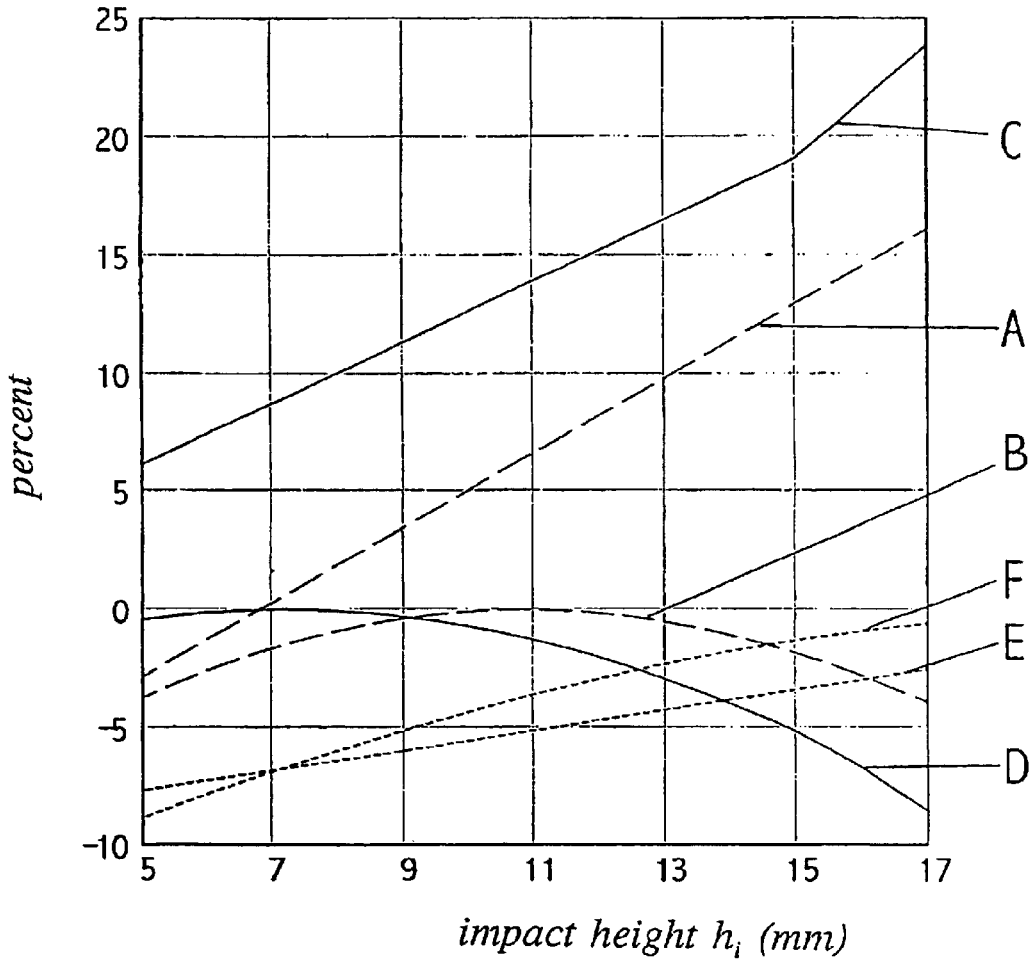

FIG. 12 shows the topspin and distance characteristics for three putter-heads, namely, two heads identified individually as Head 1 and Head 2, according to the present invention, and a third head according to the prior art. The parameters of the three heads are set out in Table III.

TABLE III

| | Head 1 | Head 2 | Prior Art |
|---|---|---|---|
| M | 0.32 | 0.30 | 0.328 |
| K | 13.1 | 10.0 | 25 |
| p | 36 | 33 | 30 |
| $h_c$ | 6.8 | 6.0 | 16 |
| $\alpha$ | 0.0 | +1.0 | +3.0 |
| $h_\alpha$ | 0 | 15 | 0 |
| R | — | 115 | — |

Head 1 is based on the putter-head of FIGS. 6 to 9 with a silicon brass mass element (density 8.5 g $cm^{-3}$) and glass reinforced nylon upper casing (density 1.35 g $cm^{-3}$). Head 2 is a putter-head designed to give exceptionally high topspin characteristics, using a tungsten or tungsten alloy mass element (density circa 18.0 g $cm^{-3}$). The prior-art head is a known implementation of a mallet style putter-head with mass distribution intended to reduce initial skidding on a putt (by reducing imparted backspin).

In FIG. 12, the X-axis gives the height $h_i$ on the putter face (measured from the extreme bottom of the putter-head) of impact with the ball, and the Y-axis gives the percentage variation. Trace A shows topspin for Head 1 and trace B shows relative putt distance for constant putter-head impact velocity. From this, it can be seen that 5% to 8% topspin are obtained for impacts in the range 10 to 12 millimeters, whereas topspin of 15% or more can be achieved by controlling the putter-head to strike the ball near the bottom of the swing with the sole of the putter fairly close to the putting surface. Trace B shows that the variation in distance is closely controlled in Head 1 and, advantageously, approximately symmetric about 11 millimeters impact height. In the impact height range 5 to 17 millimeters the distance decrement is less than 4%.

Traces C and D of FIG. 12 show topspin and relative distance for Head 2. Here very high topspin is generated throughout the normal impact height range, but distance loss increases slightly at high impact heights. A special feature of Head 2 is that the impact-face is profiled with a loft of +1 degree above 15 millimeters height, decreasing at a uniform rate below this height to 4 degrees at 5 millimeters height. Despite this negative loft, the putter still imparts lift (that is to say, positive elevation ball trajectory). For impacts above 9 millimeters, the gear-effect is more than sufficient to impart upward velocity greater than the component of downward velocity due to negative loft. Impacts below 9 millimeters height only arise if the putter-head is raised high off the putting surface at the bottom of a pendulum swing (that is, the shot is badly executed) or, more preferably, if the putter-head is on an upward trajectory and this itself imparts lift to the ball at impact.

Traces E and F of FIG. 12 show spin and relative distance for a prior-art putter-head. With this head function G=575, which provides moderate dS/dh, but the high $h_c$ combined with positive loft results in backspin increasing significantly with low impact-height and this in turn results in (the predicted) loss of distance at low impact height. In practice, the shaft coupling of this head would tend to improve putt-length variation but slightly further increase the sweet-spot height.

Because imparted topspin in the present invention relies on impacts being off-centre from the 'sweet spot', levels of head-vibration can be greater than that obtaining in a conventional putter where sweet-spot impact is expected. The known method of reducing such vibration is to clad the metal or other low-loss parts with high-loss materials. Advantageously, the major part of the putter-head according to the invention can be made from a high-loss material such as a polymer or composite (Ashby, M. A. 1992. *Materials Selection in Mechanical Design,* $2^{nd}$ ed., Oxford: Butterworth-Heinemann, pp. 46–48). If necessary, cavities or recesses in the putter-head can be provided and filled with high loss materials, provided these do not reduce the overall rigidity of the putter-head. Other methods for low-frequency vibration control include filling the shaft with vibration dampening material such as granular material sold under the Trade Mark LODENGRAF.

Figure 13:
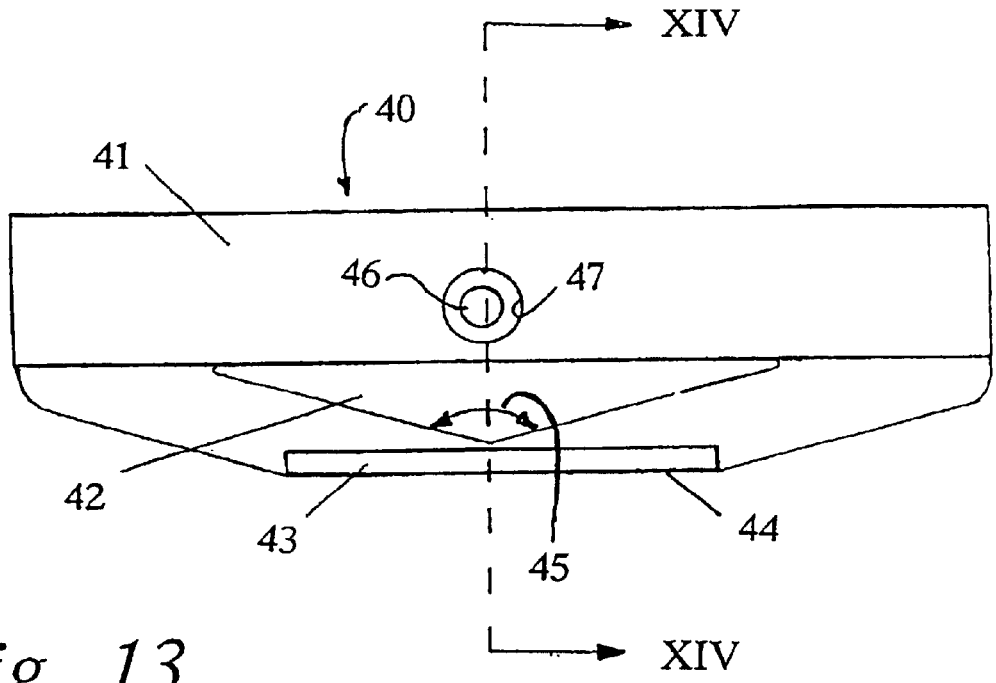
FIGS. 13 and 14 are a plan view and a sectional side-elevation, respectively of a further putter-head according to the invention the section of FIG. 14 being taken on the line XIV—XIV of FIG. 13.
Figure 14:
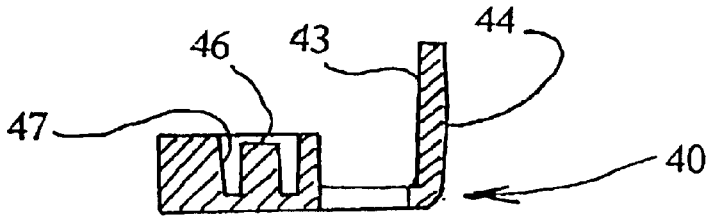

Referring now to FIGS. 13 and 14, a putter-head body 40 is fabricated from a single material such as metal alloy or high density composite. With a metal-only body, the putter-head can advantageously be cast to allow high volume, low cost manufacture. In this form, the body 40 is preferably made of a high loss alloy such as cast iron, low-carbon steel, zinc alloy or manganese-copper alloy.

The greater part of the head-mass is provided by the rear-body section 41 which preferably extends, heel to toe, at least 120 millimeters or significantly more (so as to be longer than an average putter-head). This helps to reduce the moment of inertia about the heel-toe axis and advantageously increases the moment of inertia about the central vertical axis. The provision of a chevron-shaped cut-away 42 between the rear-body section 41 and the front flange 43 with its impact-face 44, further reduces the heel-toe moment of inertia.

The cut-away 42 also provides an alignment aid when addressing a ball during play. Small differences in alignment relative to the intended line of putt are shown up by the obtuse angle 45. In an alternative arrangement, the cut-away 42 is replaced by a thin plate section and the chevron-shaped feature is highlighted with a contrasting-colour paint. In another arrangement, a bridge part can be provided across the centre, so dividing the cut-away into two symmetrical apertures.

In this embodiment of the invention, the putter-shaft (not shown) is attached at or close to the centre of mass of the putter-head by a re-entrant 'over-hosel' arrangement (best seen in FIG. 14). More particularly, a tapered stub 46 projects upwardly coaxially within a cylindrical recess 47 in the rear-body section 41 of the head 40. The hollow end of the putter-shaft is fitted onto the stub 46 leaving space between it and the cylindrical wall of the recess 47. This space is filled with a high-toughness, flexible adhesive that is also used to secure the shaft to the stub 46. so as to form a strong but compliant bonding of the shaft to the head 40. The adhesive is preferably coloured to enhance the appearance of the join.

What is claimed is:

1. A putter-head having a centre of mass located at a distance p millimeters behind its impact-face at a height $h_c$ millimeters above the bottom of the head, a moment of inertia/kilogrammes-millimeters$^2$ about the vertical axis through the centre of mass, a mass of M kilogrammes and a radius of gyration of K millimeters about the heel-toe axis of the head through the centre of mass, wherein:

(a) p/l is not more than 0.18;

(b) $h_c$ is less than $[12-p\times\sin(\alpha_{12})]$ where $\alpha_{12}$ is the loft angle at a height of 12 millimeters above the bottom of the head; and (c) a parameter G defined by:

$$G=p+(3.2+70\times M)\times K^2/p$$

has a value less than 350.

2. The putter-head according to claim 1 wherein the value of G is less than 250.

3. The putter-head according to claim 2 wherein the value of G is less than 170.

4. The putter-head according to claim 1 wherein height $h_c$ is not more than 8.5 millimeters.

5. The putter-head according to claim 2 wherein height $h_c$ is not more than 7 millimeters.

6. The putter-head according to claim 1 wherein the ratio $d_1/K$ is less than 1.0, where $d_1$ millimeters is the horizontal offset from said heel-toe axis of the axis of attachment of the putter-shaft to the putter-head.

7. The putter-head according to claim 6 wherein the ratio $d_1/K$ is less than 0.33.

8. The putter-head according to claim 6 having a putter-shaft of radius r millimeters, wherein $d_1$ is less than r.

9. The putter-head according to claim 6 wherein $d_1$ is zero.

10. The putter-head according to claim 1 wherein the ratio $d_2/K$ is less than 1.0, where $d_2$ millimeters is the vertical offset above said heel-toe axis of the axis of attachment of the putter-shaft to the putter-head.

11. The putter-head according to claim 10 wherein the ratio $d_2/K$ is less than 0.33.

12. The putter-head according to claim 10 wherein $d_2$ is negative.

13. The putter-head according to claim 1 wherein the axis of putter-shaft attachment to the putter-head is spaced by less than K millimeters from the centre of mass.

14. The putter-head according to claim 1 wherein the axis of putter-shaft attachment to the putter-head is spaced by no more that the radius r millimeters of the putter-shaft from the centre of mass.

15. The putter-head according to claim 1 having impact-face loft angles $\alpha_5$and $\alpha_M$ at heights of 5and $h_M$ millimeters respectively, above the bottom of the head, the height $h_M$ being given by:

$$h_M=h_c+p\times[0.12+\sin(\alpha_M)],$$

wherein a function $D_5$ defined by:

$$D_5=[(3.2+70\times M)\times K^2+p^2]\times[h_M-5+p\times\sin(\alpha_5)]^{-2}$$

has a value that is more that 37.

16. The putter-head according to claim 15 wherein the function $D_5$ has a value that is not less than 60.

17. The putter-head according to claim 15 wherein the function $D_5$ has a value that is not less than 120.

18. The putter-head according to claim 1 having impact-face loft angles $\alpha_{17}$ and $\alpha_M$ at heights of 17 and $h_M$ millimeters respectively, above the bottom of the head, the height $h_M$ being given by:

$$h_M=h_c+p\times[0.12+\sin(\alpha_M)],$$

wherein a function $D_{17}$ defined by:

$$D_{17}=[(3.2+70\times M)\times K^2+p^2]\times[h_M-17+p\times\sin(\alpha_{17})]^{-2}$$

has a value that is more that 37.

19. The putter-head according to claim 18 wherein the function $D_{17}$ has a value that is not less than 60.

20. The putter-head according to claim 18 wherein the function $D_{17}$ has a value that is not less than 120.

21. The putter-head according to claim 1 wherein the impact-face has upper and lower sections that are contiguous with, and merge smoothly into, one another, the upper section being a flat surface and the lower section having the form of part of the surface of a cylinder that has its axis parallel to the heel-toe axis of the putter-head.

22. The putter-head according to claim 1 wherein for impact at any point on the impact-face, the following function involving the height $h_i$ of that point above the bottom of the head and the loft $\alpha_i$ of the impact-face at that point, namely:

$$h_i-p\times\sin(\alpha_i)$$

is more than the height $h_c$.

23. The putter-head according to claim 1 wherein the impact-face is a flat surface.

24. The putter-head according to claim 1 comprising two parts a first of which is of high-density material and the second of which is of a lower-density material, the two parts being bonded together with the first part under the second part or located low down within it.

25. The putter-head according to claim 1 of metal or high-density composite having an upstanding front flange and a rear body-portion spaced from the flange, wherein the rear body-portion is of larger mass than the flange and extends beyond it in either direction lengthwise of said heel-toe axis.

* * * * *